US008701228B2

(12) United States Patent
Cliffton

(10) Patent No.: US 8,701,228 B2
(45) Date of Patent: Apr. 22, 2014

(54) METHOD OF PROMOTION AND ADVERTISING FOR HOTEL OR OTHER PLACE OF ACCOMMODATION USING CUSTOMIZED PILLOW SCARVES ON A BED

(76) Inventor: Susan Ann Martenson Cliffton, Eden, UT (US)

( * ) Notice: Subject to any disclaimer, the term of this patent is extended or adjusted under 35 U.S.C. 154(b) by 0 days.

(21) Appl. No.: 13/347,263

(22) Filed: Jan. 10, 2012

(65) Prior Publication Data

US 2012/0102644 A1 May 3, 2012

Related U.S. Application Data

(63) Continuation-in-part of application No. 13/161,360, filed on Jun. 15, 2011, now Pat. No. 8,479,330.

(60) Provisional application No. 61/355,135, filed on Jun. 15, 2010, provisional application No. 61/380,543, filed on Sep. 7, 2010.

(51) Int. Cl.
*A47G 9/02* (2006.01)

(52) U.S. Cl.
USPC ..... 5/482; 5/486; 5/491

(58) Field of Classification Search
USPC ..... 5/482, 486, 490–491, 501, 503.1
See application file for complete search history.

(56) References Cited

U.S. PATENT DOCUMENTS

| | | | | |
|---|---|---|---|---|
| 4,815,156 | A * | 3/1989 | Williams | 5/485 |
| 5,118,553 | A | 6/1992 | Boisson | |
| 6,627,284 | B1 * | 9/2003 | Naidj | 428/40.1 |
| 2007/0022531 | A1 * | 2/2007 | Lyons | 5/122 |

* cited by examiner

*Primary Examiner* — Fredrick Conley
(74) *Attorney, Agent, or Firm* — David W. Barman

(57) ABSTRACT

The invention relates to a method of promoting a hotel or other place of accommodation through the use of a customized pillow scarf on the guests' beds. The customization is preferably embroidery, and can include the name and/or logo of the hotel, and, optionally, even the guest's names or initials. The pillow scarves are also intended for, optionally, being given away as souvenirs or sold in the hotel gift shop, with the goal of increasing repeat business and new business as the former guest uses the pillow scarf in his/her house and is asked about it by visitors.

10 Claims, 4 Drawing Sheets

METHOD OF PROMOTION AND ADVERTISING FOR HOTEL OR OTHER PLACE OF ACCOMMODATION USING CUSTOMIZED PILLOW SCARVES ON A BED

CROSS REFERENCE TO RELATED APPLICATIONS

This application is a continuation in part of U.S. patent application Ser. No. 13/161,360 filed on Jun. 15, 2011 now U.S. Pat. No. 8,479,330, which in turn claims benefit to U.S. Provisional App. No. 61/355,135 filed on Jun. 15, 2010 and U.S. Provisional App. No. 61/380,543 filed on Sep. 7, 2010, the entireties of which are hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of promotions for a hotel, bed and breakfast, or other place of accommodation, and more specifically toward the use of a customized pillow scarf that hides the upper portion of a made bed from view. The scarf includes a portion of material having a length and a width, opposite first and second ends and opposite top and bottom edges. The length of the scarf is sufficient to cover pillows placed on a made bed of standard size, with the opposite first and second ends reaching opposite first and second edges of the bed. The width of the scarf is sufficient so that its top edge hides the top edge of a pillow on the made bed, and the bottom edge hides the bottom edge of the pillow on the made bed. The scarf may be used to cover up the top edge of a bed sheet, blanket or bedspread on a made bed so as to hide said top edge of the bed sheet, blanket or bedspread, or, could be used independently of the bed covering that covers the main body of the mattress.

It is important to note that one feature of the pillow scarf that makes it such a valuable advertising and promotional item is its versatility. Since the pillow scarf can be made with various widths and lengths, it could be designed to be a throw, a cover to use when sitting in a chair reading a book or laying down to take a nap, even a small blanket. A user could also use the pillow scarf as a wrap to use when sitting in a chair or couch or to go out to the pool. Depending on the outside temperature, and season, the place of accommodation which uses the pillow scarf may have use materials that offer differences in warmth depending on the season, may make some pillow scarves waterproof, and may even make it reversible to enhance its desirability to a guest. Indeed, having a pillow scarf with different types of material on either side may be beneficial to effectively display a logo on one side and be "functional", such as a terry cloth side for use as a towel, on the other.

Additional value as a promotional piece can be achieved by a hotel, bed and breakfast, or other place of accommodation by custom-tailoring the pillow scarf to a particular clientele, or even specific guests. For example, there can be pillow scarves designed with the age, gender and interests of the clientele taken into consideration. Pillow scarves can even be designed with different art genres in mind.

By using a pillow scarf that has been customized to display the logo and/or name of the hotel or other place of accommodation, the guest is constantly reminded of where he or she is staying, thus more firmly cementing in their mind the identity of the user of the invention. Hotel chains may sell or give the pillow scarves to the guests, and then acquire ongoing advertising and promotional exposure as the guest uses the pillow scarf at home after the hotel stay. An alternative embodiment of the idea is to create customized pillow scarves with the name of the guest on the pillow scarf, along with the name of the place of accommodation, such that the guest is pleasantly surprised at how valued he or she is as a guest, and will take the pillow scarf home with him or her. The pillow scarf will then remind the guest frequently of the attention lavished upon him or her by the place of accommodation, making it more likely that guests will either return to the place of accommodation and/or tell their friends about the good time they had there, thereby increasing both return and new business for the user of the invention.

The use of hotel logos for advertising is not novel, but in the current recession, hotels, bed and breakfast inns, and other places of accommodation (hereinafter referred to generally as hotels) are looking for every last advantage possible in trying to attract and retain customers. The first thing that most guests look at when they walk into a room is the bed. It would be advantageous to a hotel to have the first thing the guests see when they walk into the room be a logo that clearly reminds them that they are in a certain hotel. It would also be a pleasant surprise for guests to walk into a room with a pillow scarf on the bed that had their name or initials customized on the pillow scarf along with the hotel chain's name. With the hotel's logo and/or design placed on the pillow scarf, the hotel's identifying information is elevated front and center for viewing.

Particularly in the bed and breakfast industry, customer service is given a high priority, and making guests feel as though they are "special" is essential to the growth, and in times of recession, even survival of a bed and breakfast establishment. The use of a pillow scarf, which is fairly simple and inexpensive to manufacture, that the guest takes home with him or her, would be an effective way for the bed and breakfast establishment to set itself apart from the others.

It is also envisioned that other methods of attaching an item of indicia to a pillow scarf would be preferable under certain circumstances. For example, should a place of accommodation wish to customize a pillow scarf for each guest, or for their high-profile guests, or even for repeat guests, it is contemplated that a less expensive means of putting the guest's initials or name on the pillow scarf would be possible. For example, silk screening, calligraphy with indelible inks and other methods of putting a logo on a pillow scarf are contemplated.

In addition, if the hotel is going to customize each pillow scarf for a guest, they will need an embroidery machine or some other way to produce these customized pillow scarves out quickly and inexpensively. For example, a hotel could have arrangements employing a quality approved local embroidery shop. The embroidery shop could physically have pillow scarves on hand and the hotel could call in an order.

The desirability of using pillow scarves to promote a hotel or other place of accommodation is also reflected in the usefulness of pillow scarves. For example, the pillow scarf aides in the making up the bed quicker saving time and time being money. They also aid in covering up the pillows that have been previously slept on giving the made up bed a fresh look daily. With establishments promoting a Green Environment and asking guests to consider not having linen changed every day, the pillow scarf can effectively help to achieve this goal.

Thus there has existed a long-felt need for a method of attracting and retaining customers, and effectively promoting a hotel chain, through the use of customized pillow scarves.

SUMMARY OF THE INVENTION

The current invention provides just such a solution by providing a method by which a hotel can reinforce to its guests where they are staying and enhances their experience such that they are more likely to return and/or tell their friends about the hotel.

It is a principal object of the invention to provide a method by which a hotel can reinforce to its guests where they are staying by having the first thing most guests look at reflect the identity of the hotel.

It is another object of the invention to provide a method by which hotels can create a customized pillow scarf that can be used over the pillow or over the end portion of the bed, such that the customized pillow scarf gives the guests a constant reminder of where they are staying.

It is another object of the invention to promote a hotel by creating a customized pillow scarf that is eye-pleasing and functional, and includes the hotel's logo and/or name, and then allowing the guest to take it home as a souvenir of his or her visit or to sell the same customized pillow scarf in the hotel gift shop.

It is another object of this invention to provide a method of advertising and promotion whereby a hotel custom embroiders on a pillow scarf the name or initial of a guest, and allows the guest to take home the pillow scarf as a souvenir of his or her visit.

It is a final object of this invention to provide a method by which a hotel or other place of accommodation can make both a first and last impression on a guest, by providing a pillow scarf that is the first thing the guest sees, and that is so attractive in appearance that the guest takes it home and uses it in his or her house after the stay in the hotel.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
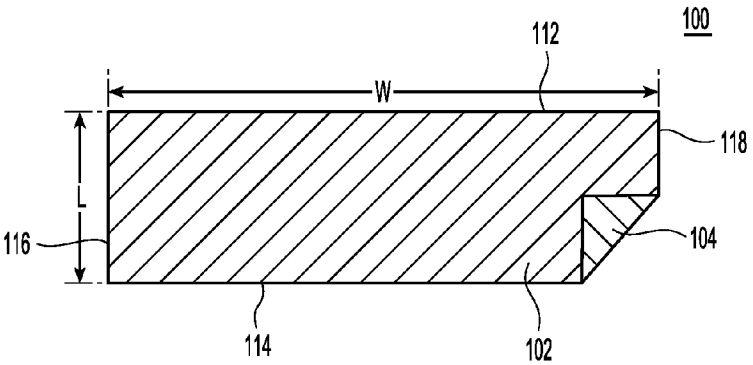
FIG. 1 shows one embodiment of a pillow scarf in accordance with the present invention.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

Before understanding the method of using a pillow scarf to promote to hotel chain or other place of accommodation, it is important to understand the concept of the pillow scarf and how one is created.

The hotel begins by creating the pillow scarf, which comprises a portion of material having first and second sides, a top edge, a bottom edge and opposing side edges. The pillow scarf has a width W defined as a distance between the opposing side edges and a length L defined as a distance between the top and bottom edges. The width W is sufficient to cover at least one pillow placed proximate the head of a bed of standard size with the opposite first and second side edges of the pillow scarf reaching at least opposite first and second edges of the bed. The length L is sufficient to hide the at least one pillow from view between the top and bottom edges of the pillow scarf.

In some embodiments, the length of the pillow scarf may be sufficient extend part-way down opposite sides of the bed. In some embodiments, the length of the pillow scarf may be sufficient extend substantially to the floor, on both sides of the bed.

The pillow scarf may have a pattern that corresponds to a pattern of a bed sheet, blanket, or bedspread also visible on the same bed.

The pillow scarf may have indicia associated with an establishment in which the pillow scarf is placed on a bed, or may have an item of indicia related to the guest staying in that particular room, or both on the same pillow scarf.

In another aspect, the present invention is directed to a kit comprising the aforementioned pillow scarf and decorative material. The decorative material may comprise one or more of sequins, buttons, markers, patches and thread.

In yet another aspect, the present invention is directed to a method of covering at least one pillow positioned proximate the head of a bed of standard size. The method comprises providing a pillow scarf according the above-described pillow scarf; and covering the pillows so that the opposite first and second ends of the pillow scarf reach at least opposite first and second edges of the bed, and the pillow scarf fully hides the at least one pillow from view between the top and bottom edges of the pillow scarf.

In still another, aspect, the present invention is directed to a method of covering up the upper edge of a sheet, blanket or a bedspread on a bed of standard size. The method comprises providing a pillow scarf according the above-described pillow scarf; and covering the upper edge of a sheet, blanket or a bedspread by placing the pillow scarf such that opposite first and second ends of the pillow scarf reach at least opposite first and second edges of the bed, and the top and bottom edges of the pillow scarf straddle the top edge of the sheet, blanket or a bedspread to thereby hide the latter from view.

The pillow scarf can be sold by the hotel chain to guests, or given to each guest as part of the charge for the room.

The pillow scarf can also be custom embroidered for each guest, with the guest's name or initials on the pillow scarf, along with the name of the hotel chain.

In an alternate embodiment of the invention, the pillow scarf can be custom embroidered for only the most expensive suites in a hotel, or for only celebrity visitors.

FIG. 1 shows a pillow scarf 100 in accordance with one embodiment of the present invention. The pillow scarf 100 comprises a generally rectangular piece of bedding material having opposing first and second sides 102, 104, a top edge 112, a bottom edge 114, and two opposing side edges 116, 118.

The first and second sides 102, 104 may have dissimilar colors, patterns and may even comprise different fabrics sewn or otherwise fixed to one another back-to-back.

As seen in FIG. 1, the pillow scarf 100 has a width W defined as the distance between the side edges 116, 118, and a length L defined as the distance between the top and bottom edges 112, 114.

The pillow scarf 100 is placed over the upper portion of a bed to cover the pillows and/or an upper edge of one or more other articles of bedding such as a sheet, a blanket, a comforter, a bed spread or the like.

Figure 2:
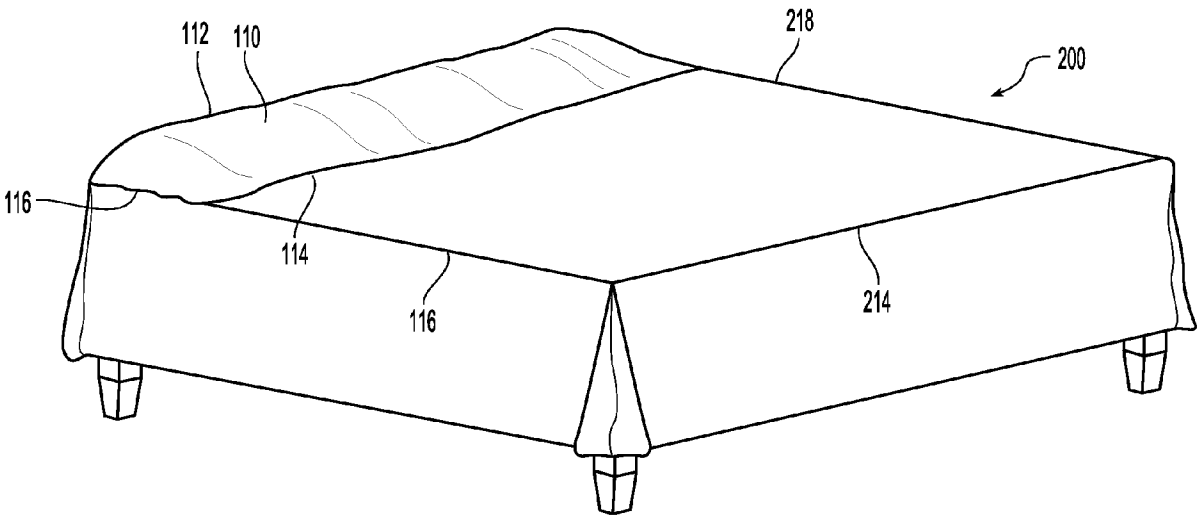
FIG. 2 shows a pillow scarf which extends to the edge of a bed.

As seen in FIG. 2, when in use, the top edge 112 of the pillow scarf 100 is closest to the top edge or headboard 210 of a bed 200 while the bottom edge 114 of the pillow scarf is away from the top edge or headboard 210 so as to cover the bedding. Thus, the length L of a pillow scarf must be sufficiently large to cover a pillow in the direction from the head of the bed to the foot 214 of the bed. In some embodiments, the length L of the pillow scarf is between 22-26 inches or about 56-66 cm.

The width W of the pillow scarf 100 must be sufficiently large to at least extend across the width of a bed 200, from a first bed side 216 to the opposite bed side 218 with sufficient "slack" to cover underlying pillows. In the embodiment seen in FIG. 2, the pillow scarf 100 is an edge-width pillow scarf 200, having a width sufficiently to only extend to the bed's opposite edges 216, 218.

Figure 3:
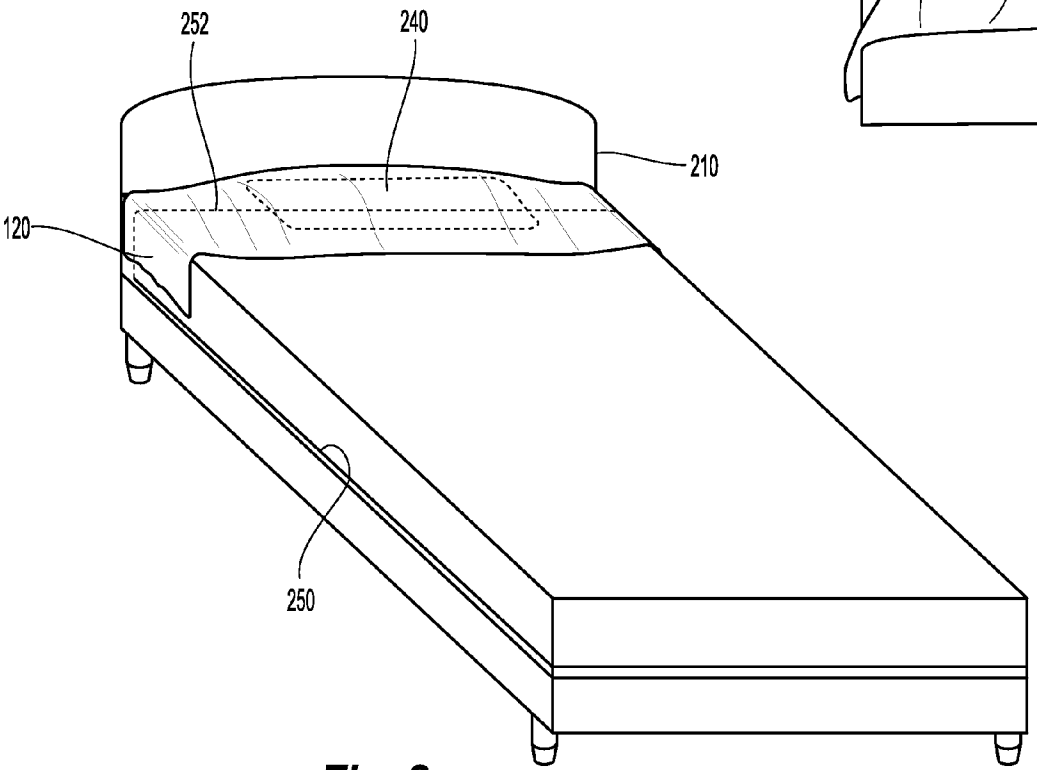
FIG. 3 shows a pillow scarf on a bed with an underlying pillow and an upper edge of another article of bedding shown in phantom.

FIG. 3 shows that a pillow scarf 120 covering not only the underlying pillow 240, but also the upper edge 252 of another bedding item 250, the upper edge 252 shown to terminate across the pillow 240. It is understood that bedding item could be a sheet, blanket, bedspread, comforter or the like. It is understood that the underlying pillow 240 may be positioned either under or over the upper edge 252. Thus, placing the pillow scarf 120 on the bed will simultaneously hide both the underlying pillow 240 and the upper edge 252 of the bedding item 250.

Figure 4:
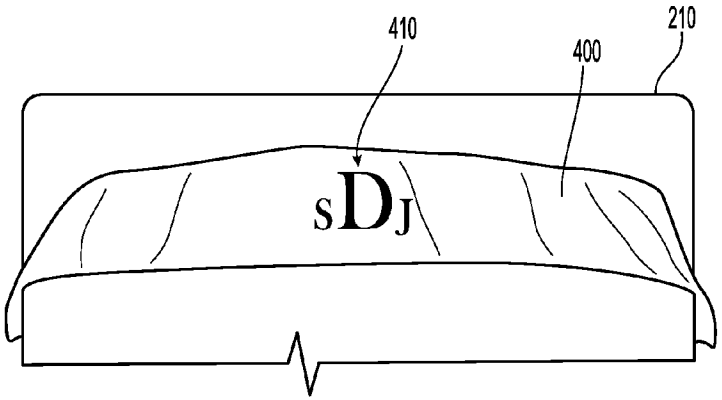
FIG. 4 shows a pillow scarf on a bed, the pillow scarf having indicia thereon

FIG. 4 shows a pillow scarf 400 having indicia 410 placed thereon. The indicia may be associated with an establishment, such as a hotel, resort or the like, in which the pillow scarf is placed on a bed. While the indicia 410 is seen in FIG. 4 to be a monogram, it is understood that the indicia could just as easily be a logo, symbol, word, phrase or the like.

Figure 5:
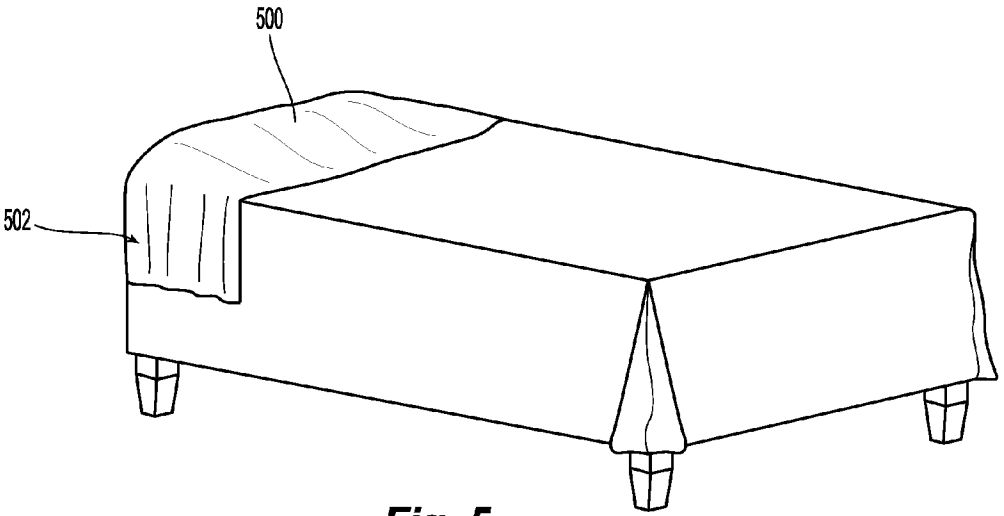
FIG. 5 shows a pillow scarf which extends mid-way along the side of a bed.

FIG. 5 shows an embodiment of a medium-width pillow scarf 500 having a width sufficient to cover the upper surface of the bed and also extend approximately mid-way down the side of the bed, roughly to the border between a mattress and box spring. The pillow scarf portion 502 extending down the side of the bed may have a different color and/or pattern than the portion covering the upper surface of the bed.

Figure 6:
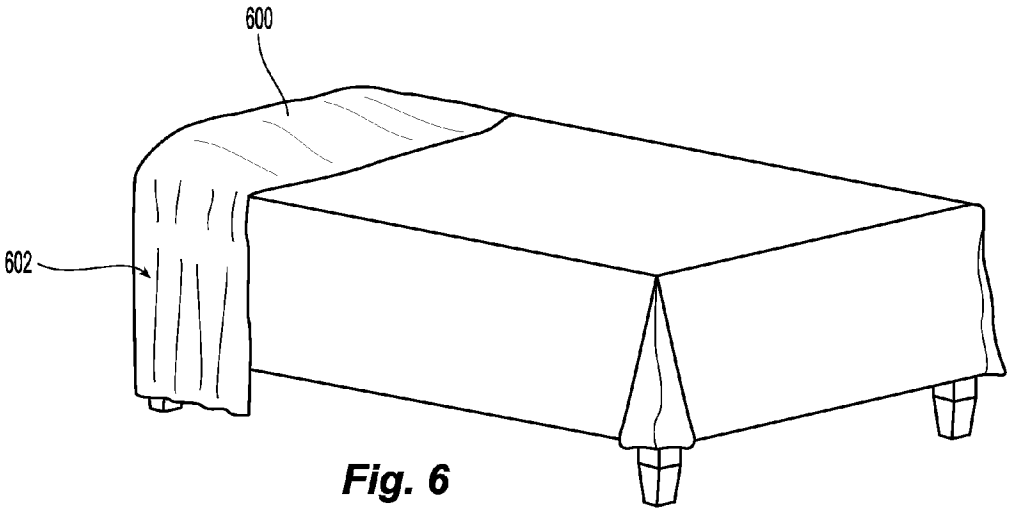
FIG. 6 shows a pillow scarf which extends to the floor along the side of the bed.

FIG. 6 shows an embodiment of a floor-width pillow scarf 600 having a width sufficient to cover the upper surface of the bed and also extend substantially to the floor along the side of the bed. The pillow scarf portion 502 extending down the side of the bed may have a different color and/or pattern than the portion covering the upper surface of the bed.

As is commonly known, standard-sized beds come in a variety of sizes including twin, twin XL, full, full XL, queen and king. Thus, it is contemplated that a manufacture and/or retailer will provide a family of pillow scarves having similar patterns and different widths. Table 1 below presents approximate pillow scarf widths for varying bed sizes and varying bed side coverage.

TABLE 1

Pillow Scarf Width Ranges For Varying Bed Sizes and Varying Bed Side Coverage

| | Edge-Width | Medium-Width | Floor-Width |
|---|---|---|---|
| Twin | 43"-47" | 72"-76" | 79"-83" |
| Twin XL | 43"-47" | 72"-76" | 79"-83" |
| Full | 58"-62" | 87"-91" | 94"-98" |
| Full XL | 58"-62" | 87"-91" | 94"-98" |
| Queen | 64"-68" | 92"-96" | 100"-104" |
| King | 82"-86" | 108"-112" | 118"-122" |

The success of this invention depends upon a well-made and attractive pillow scarf. A pillow scarf that is seen as being attractive and desirable by a guest may provide a number of promotional opportunities for the hotel chain. First, a pillow scarf in accordance with the present invention is able to cover sleeping pillows and the upper edges of a sheet, blanket or comforter, so that the bed appears to be fully made, even if it is not. In addition, a pillow scarf may be used to cover mismatched items of bedding, such as pillows having different pillow cases. Thus, placing a pillow scarf over the upper portion of a bed can be an easy and forgiving way to help make a bed. In addition, the pillow scarf allows for a single piece of bedding to change the appearance of the made bed especially when the pillow scarf has a pattern not present on the visible bedding on the remaining portion of the bed. Thus, an attractive pillow scarf will be seen by the guest as a valuable item, and one which he or she may wish to purchase or take home as a souvenir.

When used in the hotel industry, the pillow scarf can create a quick and inexpensive way to create a signature look to improve the hotel brand. Rather than having a given hotel's logo placed on a large bed spread, the hotel might opt for applying such logos to much smaller pillow scarves, thereby saving expense in the long run, especially in the event that the logo is changed. By changing out the design of pillow scarves, it is conceivable that the hotel chain could use them as collector's items, or have different styles of pillow scarves available in different seasons, so that a guest who stayed regularly at a hotel chain would see an ongoing evolution of pillow scarves. Should the hotel chain allow the guest to buy, or take home as a souvenir, the pillow scarves, offering a series of ever-changing pillow scarves would increase the likelihood that a guest who appreciated the pillow scarves would return to the hotel chain.

Figure 7:
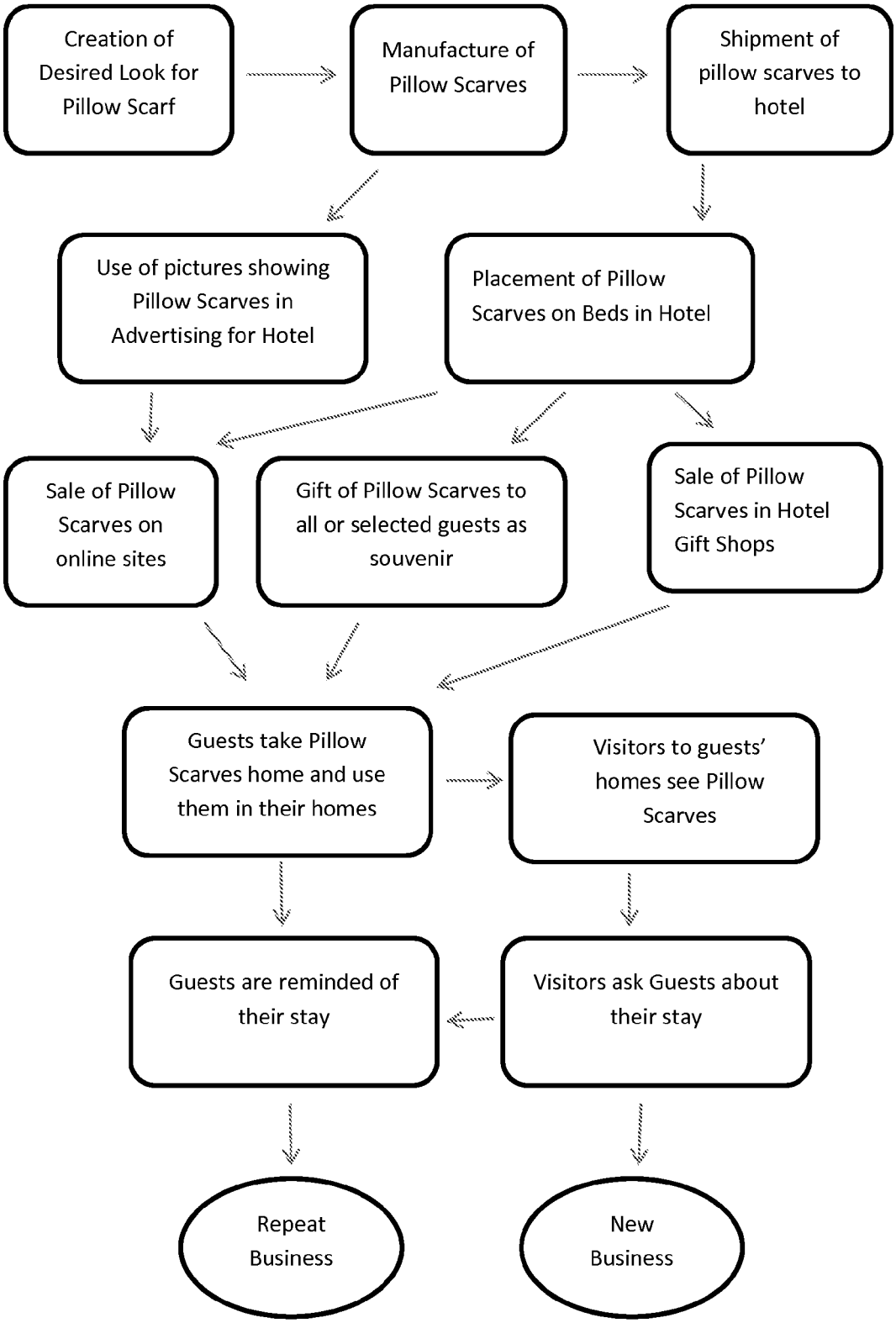
FIG. 7 shows a flow chart of the promotional method utilizing one type of pillow scarf.

FIG. 7 shows a flow chart of the promotional method utilizing one type of pillow scarf. The pillow scarf is designed, then manufactured and shipped to the hotel or other place of accommodation. Once is it manufactured, it can be used in advertisements for the hotel and sold online on internet sites, both those run by the hotel and those of other companies (for example, Amazon.com). Once the pillow scarves arrive at the hotel, they can be placed on the beds of the guests, and, optionally, either given or sold to the guests for the guests to take home. It is expected that an attractive and memorable pillow scarf will enhance the guest's experience in the hotel such that he or she is more likely to remember the hotel and either book a room again in that hotel or tell friends and acquaintances about the hotel. For those guests who take a pillow scarf home, either as a gift/souvenir or after buying it from at the gift shop or online, it is expected that the guest will use the pillow scarf in the home and remember in a positive way the hotel and have in increased chance of booking a room again in that hotel. It is also expected that a former guest using the pillow scarf at home will be asked about the pillow scarf by visitors, and not only fondly remember his/her time at the hotel, but also discuss the hotel with the visitors, making it more likely that the visitors will stay at that hotel in the future.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What I claim is:

1. A method of promoting a place of accommodation, comprising the steps of: first, selecting a pillow scarf, where the pillow scarf comprises a portion of material having first and second sides, a top edge, a bottom edge, and opposing sides, a width W defined as a distance between the opposing side edges and a length L defined as a distance between the top and bottom edges, wherein the width W is sufficient to cover at least one pillow proximate the head of a bed of standard size with the opposite first and second side edges of the pillow scarf reaching at least the opposite first and second edges of the bed, and the length L is 22-26 inches which is sufficient to hide the at least one pillow from view between the top and bottom edges of the pillow scarf, wherein said material is free of special folds and tucks and the pillow scarf has an item of indicia; and applying the pillow scarf to a bed in said place of accommodation such that the item of indicia is exposed to a person viewing said item on said bed.

2. The method of promoting a place of accommodation of claim 1, further comprising a design component based on the age of a guest, sex of a guest, religion of a ethnicity of the guest or special interest of the guest.

3. The method of promoting a place of accommodation of claim 1, wherein the item of indicia is associated with the place of accommodation or the clientele of the place of accommodation.

4. The method of promoting a place of accommodation of claim 3, where the item of indicia is a name of the place of accommodation.

5. The method of promoting a place of accommodation of claim 3, where the item of indicia is a name of a guest of the place of accommodation.

6. The method of promoting a place of accommodation of claim 5, additionally comprising an additional step of allowing the guest to purchase the pillow scarf.

7. The method of promoting a place of accommodation of claim 5, additionally comprising an additional step of allowing the guest to take the pillow scarf for free.

8. The method of promoting a place of accommodation of claim 3, additionally comprising an additional step of producing a plurality of groups of pillow scarves, where each of the plurality of groups of pillow scarves has an item of indicia that is different from the items of indicia on the pillow scarves in the other groups, and where each of the plurality of groups of pillow scarves is applied to at least one bed in the place of accommodation for a set, limited time period.

9. The method of promoting a place of accommodation of claim 8, where further comprising rotating the groups of pillow scarves over the course of two or more set, limited time periods such that one group of pillow scarves is made available during each of the set, limited time periods.

10. The method of promoting a place of accommodation of claim 9, additionally comprising offering one pillow scarf from each of the plurality of groups of pillow scarves to a guest who agrees in advance to stay at the place of accommodation.

* * * * *